US009115507B2

(12) United States Patent
Wyrostek

(10) Patent No.: US 9,115,507 B2
(45) Date of Patent: Aug. 25, 2015

(54) LANDSCAPING POST GUARD

(71) Applicant: Timothy J. Wyrostek, Curtis, OH (US)

(72) Inventor: Timothy J. Wyrostek, Curtis, OH (US)

( * ) Notice: Subject to any disclaimer, the term of this patent is extended or adjusted under 35 U.S.C. 154(b) by 0 days.

(21) Appl. No.: 14/121,677

(22) Filed: Oct. 6, 2014

(65) Prior Publication Data

US 2015/0096245 A1 Apr. 9, 2015

Related U.S. Application Data

(60) Provisional application No. 61/961,095, filed on Oct. 4, 2013.

(51) Int. Cl.
*E04H 12/22* (2006.01)

(52) U.S. Cl.
CPC ..... *E04H 12/2292* (2013.01); *E04H 12/2215* (2013.01); *E04H 12/2238* (2013.01)

(58) Field of Classification Search
CPC ..... A01G 1/08; A01G 9/02; A01G 913/0237; A01G 13/0237; A01G 13/0281; A01G 9/16; A01G 13/0243; E04H 9/12; E04H 12/2292
USPC ..... 52/170, 169.5; 47/31.1, 32, 32.4, 32.5, 47/29.5, 29.6; 256/1, 32
See application file for complete search history.

(56) References Cited

U.S. PATENT DOCUMENTS

| | | | | |
|---|---|---|---|---|
| 44,238 | A | 9/1864 | Towne | |
| 1,110,377 | A * | 9/1914 | Cowless | 47/32 |
| 1,931,602 | A * | 10/1933 | Colman | 47/32 |
| 3,287,851 | A | 11/1966 | Cramer | |
| 3,571,972 | A * | 3/1971 | Carter, Jr. | 47/32.4 |
| 3,906,664 | A | 9/1975 | Hall | |
| 4,308,688 | A * | 1/1982 | Revane | 47/32.7 |
| 4,502,244 | A | 3/1985 | Yoham | |
| 4,648,203 | A * | 3/1987 | Worzek | 47/32 |
| D295,491 | S | 5/1988 | Drumheller | |
| D301,536 | S | 6/1989 | Spear | |
| 4,858,378 | A * | 8/1989 | Helmy | 47/33 |
| 4,934,093 | A * | 6/1990 | Yanna | 47/33 |
| 5,085,001 | A | 2/1992 | Crawley | |
| 5,323,557 | A * | 6/1994 | Sonntag | 47/32 |
| 5,367,822 | A * | 11/1994 | Beckham | 47/32 |
| 5,502,921 | A | 4/1996 | Hyslop | |
| 5,605,009 | A * | 2/1997 | Elder | 47/32 |
| 5,711,106 | A * | 1/1998 | Ellis | 47/32 |
| 5,746,031 | A * | 5/1998 | Burns | 52/170 |
| 5,794,378 | A * | 8/1998 | Beatrez | 47/32 |
| 5,918,411 | A * | 7/1999 | Hadrava | 47/21.1 |
| D413,495 | S | 9/1999 | Carter | |
| D440,833 | S * | 4/2001 | Tanner | D8/1 |
| 6,349,500 | B1 * | 2/2002 | Popham | 47/32 |
| D498,994 | S | 11/2004 | Hale et al. | |
| 7,160,054 | B2 * | 1/2007 | Smiley | 404/35 |

(Continued)

*Primary Examiner* — Beth Stephen
(74) *Attorney, Agent, or Firm* — David C. Purdue

(57) ABSTRACT

A landscaping post guard comprising a base, a lower collar and an upper collar is disclosed. The base comprises a side wall having an upper lip, a tray extending inwardly from the side wall below the upper lip, a central opening, and a raised lip around said central opening. The lower collar fits inside of the side wall, below the tray. The upper collar fits inside of said raised lip around said central opening. A guard comprising a planar sheet that connects a raised peripheral rim to a central upwardly extending wall is also disclosed. Tabs extend inwardly from an upper portion of the inner wall and a slit extends from the raised peripheral rim to the central wall. A spike band may be secured to the peripheral rim.

19 Claims, 5 Drawing Sheets

(56) References Cited

U.S. PATENT DOCUMENTS

D608,166 S * 1/2010 Lozenski ..... D8/1
8,132,358 B1 * 3/2012 Wells ..... 47/21.1
8,215,056 B2 * 7/2012 Frederick ..... 47/31.1
2005/0108932 A1 * 5/2005 Hsia ..... 47/32
2011/0083364 A1 * 4/2011 Hilbert ..... 47/65.5

* cited by examiner

LANDSCAPING POST GUARD

FIELD OF THE INVENTION

The present invention relates generally to landscaping guards that protect upstanding structures and inhibit or prevent the growth of vegetation therearound.

BACKGROUND OF THE INVENTION

Lawns can be beautiful showpieces if they are properly cared for. Lawn maintenance can be a battle. Most every lawn requires periodic cutting. Some of us treat our lawns to encourage grass to grow greener and faster by applying fertilizer and insecticides and watering our lawns during dry spells. Ironically, well treated lawns require more cutting in order to keep them under control. Lawn mowing machines make grass cutting easy, especially in open areas. However, most every lawn includes any number of inanimate lawn mowing obstacles such as mail box posts, light posts and fence posts.

The invention of the string trimmer all but eliminated the use of manual grass clippers to cut grass surrounding posts. String trimmers work because the string head spins so fast that the strings become cutting instruments making string trimmers very effective for trimming grass around obstacles such as posts. A landscaper must be very precise, however, in order to trim all of the grass growing around a post with a string trimmer without nicking and damaging the post. Most of us lack that precision so we either leave the grass closest to the post uncut or we barrel in and cut all of the grass and damage the lower portions of the post in the process. Such damage can take quite a toll over the course of a season or two.

In a patent search directed to the subject matter of the present invention, the following US Patents were noted: D413,495; D498,994; 44,238; U.S. Pat. Nos. 1,931,602; 3,571,972; 3,906,664; 4,648,203; 4,858,378; 5,085,001; 5,323,557; and 5,502,921.

SUMMARY OF THE INVENTION

The present invention is a landscaping vegetation guard and post protector for positioning around an inanimate grass cutting obstacle such as a post or a fire hydrant or the like. Such obstacles will be referred to herein as posts.

In one embodiment, the guard comprises a generally planar sheet of flexible material that connects a raised rim that extends around the periphery of the guard to a central upwardly extending wall that, in use, surrounds a lower portion of the post. Tabs are provided which extend inwardly from an upper portion of the inner wall and portions of the tabs engage the post in use. A slit extends from the raised rim to the central wall so that the guard may be manipulated and positioned around the post with the central wall surrounding the post. In a preferred example of the invention, the raised rim is defined by an inner wall and an outer wall with their upper edges connected to each so as to define a groove that is open at the lower edges of the inner and outer walls. At least one spike band is included and comprises a plurality of spikes extending downwardly from a strip that is received in and secured in the rim groove so that the spikes extend downwardly to engage the ground.

In another embodiment, the guard comprises a base, an upper collar and a lower collar. The base comprises a raised outer rim with spikes extending downwardly from the rim, a central opening, a raised rim around the central opening, and a flange extending inwardly from the raised rim around the central opening. The lower collar has a periphery corresponding with the periphery of the base. The upper collar has a periphery corresponding with the periphery of the flange extending inwardly from the raised rim around the central opening.

It is an object of the present invention is to provide a landscaping guard which will prevent the growth of vegetation in the area immediately adjacent to a post Another object of the present invention is to provide a landscaping guard that is easily installed around a post.

Another object of the present invention is to provide a landscaping guard with centrally located tabs which can be snugged up against a post and positively connected to the post to provide maximum protection against vegetation growing above the guard.

Yet another object of the present invention is to provide a landscaping guard that eliminates the need to use lawn equipment to trim vegetation around the post thereby preventing damage to such posts.

Still another object of the present invention is to provide a landscaping guard that defines a trough for receiving and retaining decorative landscaping material such as mulch or stone or the like.

Another object of the present invention is to provide a landscaping guard having a central wall with tabs extending inwardly therefrom so that the tabs can be manipulated when the guard is installed to be positioned between the post and the wall.

Another object of the present invention is to provide a landscaping guard with a raised outer rim that can be configured to have any desired shape.

A still further object of the present invention is to provide a landscaping guard which is simple to manufacture.

These and other objects, features and advantages of the present invention will become readily apparent to someone having skill in this art from the following description when considered together with the accompanying drawings.

DETAILED DESCRIPTION OF EMBODIMENTS OF THE INVENTION

Figure 1:
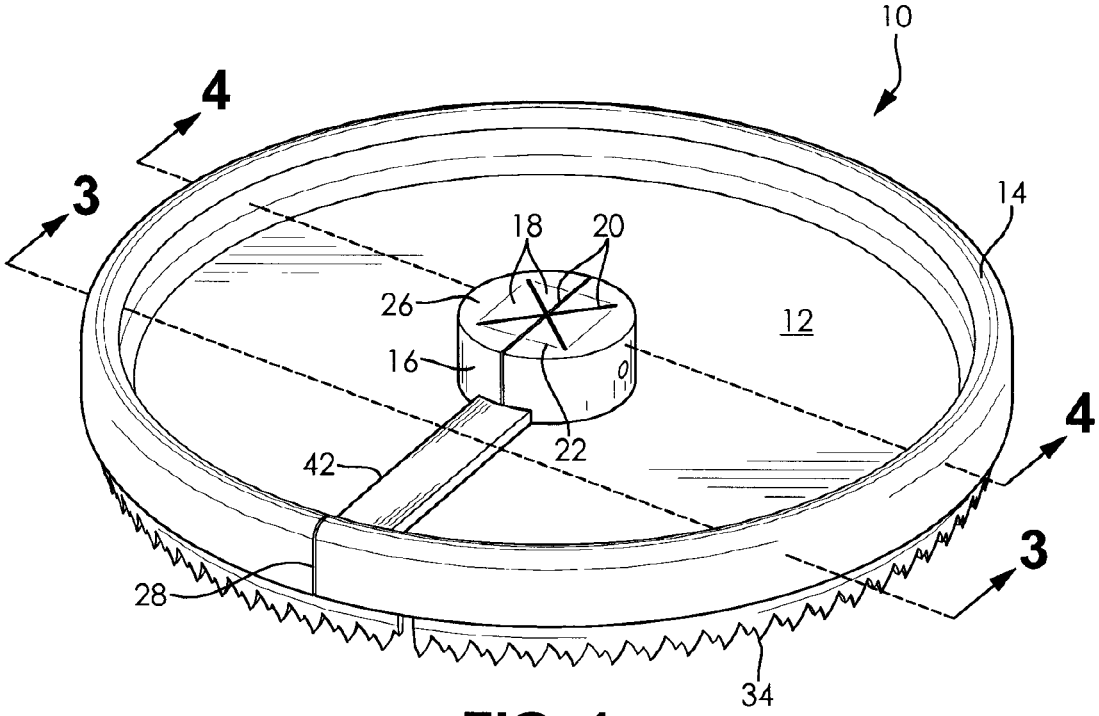
FIG. 1 is an upper perspective view of an example of the landscaping guard of the present invention.

A landscaping guard according to one example of the present invention is indicated generally at 10 throughout drawing FIGS. 1 through 6. The guard 10 comprises a planar sheet 12 that extends inwardly from a raised rim 14 to a central wall 16. The planar sheet 12 constitutes a tray on which decorative landscaping material may be placed although such material constitutes no portion of the invention. The raised rim 14 defines a continuous wall around the periphery of the guard 10. The central wall 16 is a continuous wall as well. Thus, the raised rim 14 and the central wall 16, together with the planar sheet 12 define a trough region which will retain decorative landscaping material within the confines of the landscaping guard 10. The planar sheet 12 serves to prevent vegetation from growing upwardly into the trough region.

In the drawing Figures, the raised rim 14 is illustrated as having a circular shape. It will be appreciated, however, that the raised rim 14 may be formed in a virtually infinite number of shapes such as a star shape, an animal shape, a polygon, and so on. In those cases, the outside of the planar sheet 12 would have a shape corresponding with the shape of the raised rim 14. The central wall 16 is also illustrated as having a circular shape. It also will be appreciated that the central wall 16 may be formed in a virtually infinite number of shapes such as a star shape, an animal shape, a polygon, and so on. In those cases, the central region of the planar sheet 12 would have a shape corresponding with the shape of the central wall. In other words, it is preferred that the planar sheet extend from the raised rim 14 to the central wall 16 in a continuous fashion so that the bottom and sides of the trough region are completely closed and vegetation is prevented from growing from the ground into the trough region.

In the drawing figures, the height of the raised rim 14 is roughly the same as the height of the central wall. This is not necessary, however, to achieve the objects of the invention. The raised rim 14 may be higher than the central wall 16 and vice-versa. It is generally preferred that the height of the central wall 16 be at least about equal to the height of the raised rim 14 although this is not necessary. So long as the depth of any decorative landscaping material that is put into the trough region is not significantly greater than the height of the raised rim 14 and the height of the central wall 16, the landscaping guard 10 will be operable to retain the material in the trough region. Further opportunities for aesthetic enhancements to the guard 10 are presented by the possibility of providing one or more raised portions (not shown) within the trough region extending upwardly from the planar sheet 12 between the raised rim 14 and the central wall 16 and having any desired shape. For example, cat fanciers might enjoy seeing such a raised portion (not shown) defined by an upwardly extending wall formed in the shape of the outline of a cat. Decorative landscaping material would highlight the shape of such a decorative raised portion.

Figure 6:
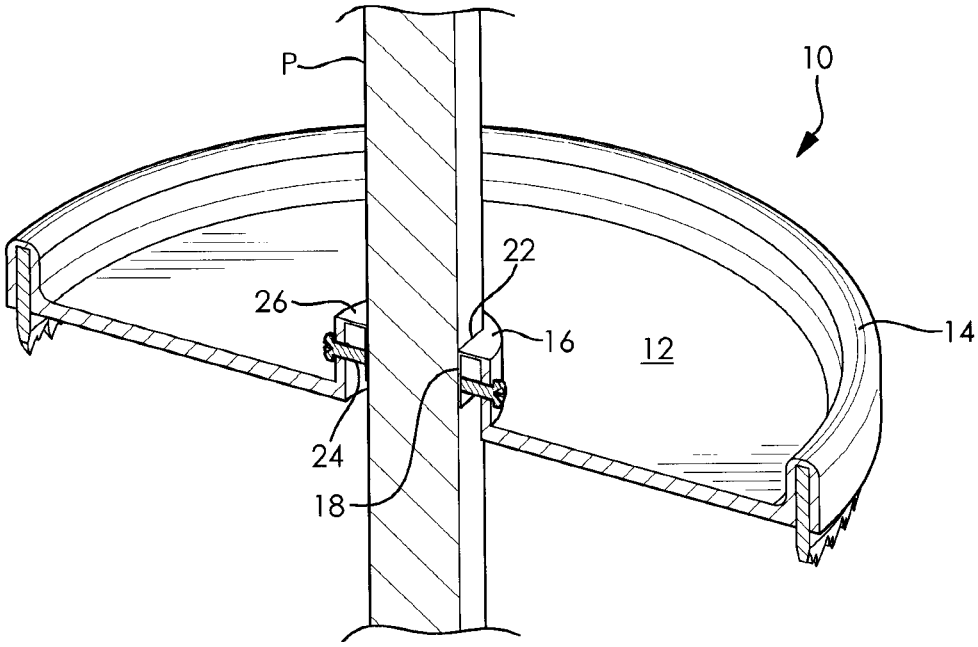
FIG. 6 is an upper perspective cross sectional view of the landscaping guard shown in FIG. 5.

Tabs 18 extend inwardly from the top of the central wall 16. Slits indicated at 20 separate the tabs 18 and the tabs 18 are formed of a flexible material so that they may be pivoted about axes indicated at 22. When the tabs 18 are pivoted downwardly, as shown in FIG. 6, they are hidden from sight within the central wall 16. It is preferred that central wall 16 and the pivoted tabs 18 be secured relative to a post indicated by the letter P in FIGS. 5 and 6, as by fasteners 24 that extend through the central wall 16 and the tabs 18 and into the post P. A flange 26 extends from the central wall 16 to the tabs 18 and, when the tabs 18 are pivoted downwardly, as shown in FIG. 6, the flange 26 extends from the central wall 16 to the post P, preferably in a way that the flange 26 is up tight against the post P. It will certainly be appreciated that the post P might have a square cross section such as the post P illustrated in FIGS. 5 and 6 or a rectangular cross section (not shown). In these cases, four tabs 18 may provided with the tab axes positioned so that the flange is snug up against the post. The post might have a round cross section (not shown) and, in that case, more than four tabs 18 may be provided so that the flange is snug up against the post. It is preferred to have a central wall that conforms to the shape of the cross-section of a post with which guard 10 is going to be used. In this case, a small gap would be provided between the central wall and the post so that the tabs, when they are pivoted to extend downwardly, are held fast against the post by the central wall. In such a case, there would be no flange 26 because the axes would be adjacent to the posts. This arrangement facilitates the use of fasteners to fasten the tabs and the central wall to the post because there would be virtually no space between the tabs and the central wall.

A slit indicated at 28 is formed in the raised rim and extends therefrom along the planar sheet 12 to the central wall 16 and into the flange 26 and across to an opposed flange, portion at the opposite side of the central wall. When installing the guard 10 around a post, the guard is manipulated so that it flexes and the two edges that define the slit 28 separate to create an opening through which the post passes until the guard 10 is positioned with the post inside of the central wall 16. During this operation, the tabs 18 may also be flexed and pivoted to the positions shown in FIGS. 5 and 6. Once the guard 10 is so positioned, it is released and it returns to the configuration shown in the drawing Figures. When the post P is within the confines of the central wall 16, the central wall 16 and the adjacent tabs 18 are secured to the post P by the fasteners 24.

Figure 2:
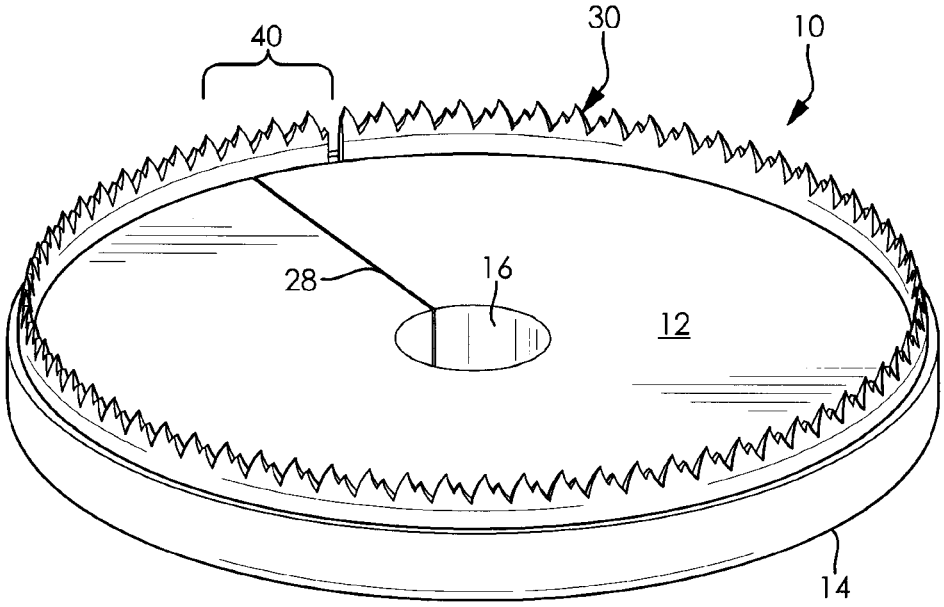
FIG. 2 is a bottom perspective view of the landscaping guard shown in FIG. 1.
Figure 3:
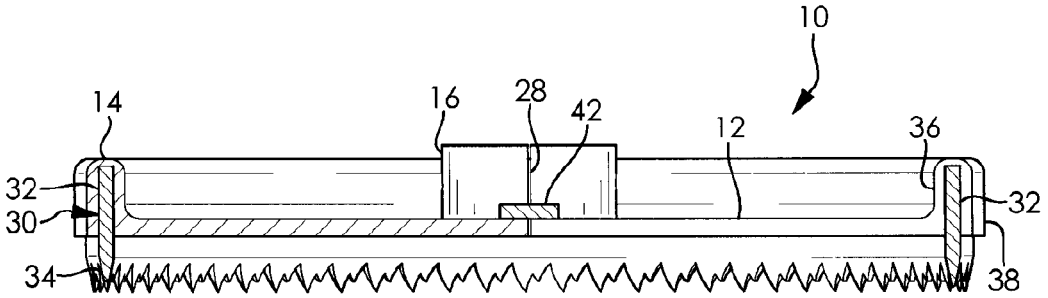
FIG. 3 is a cross sectional view taken along the line 3-3 of FIG. 1.
Figure 4:
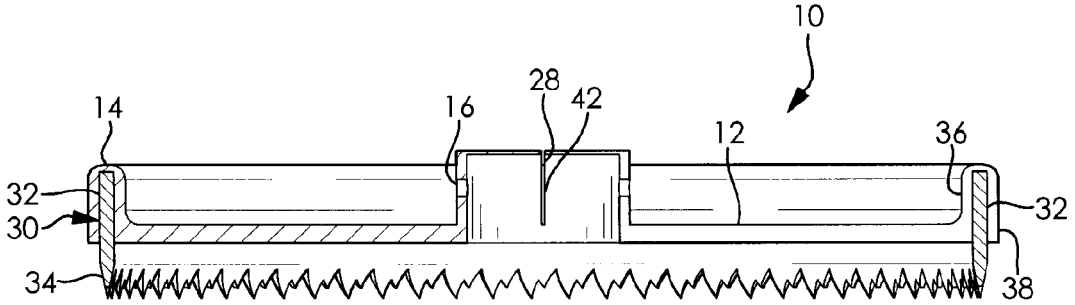
FIG. 4 is a cross sectional view taken along the line 4-4 of FIG. 1.
Figure 5:
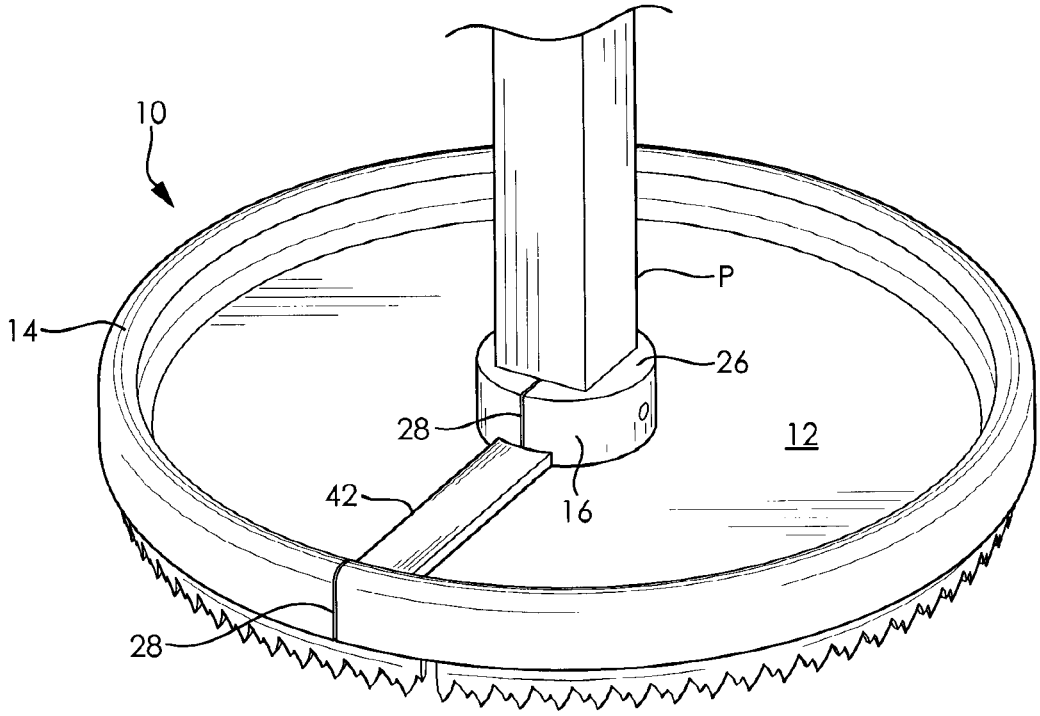
FIG. 5 is an upper perspective view of an example of the landscaping guard of the present invention after it is installed around a post.

In order to secure the guard 10 relative to the ground beneath it, at least one spike band 30 (FIGS. 3 and 4) is provided and it comprises a strip 32 and spikes 34 extending from the strip 32. The raised rim 14, as shown in FIGS. 3 and 4, comprises an inner wall 36 and an outer wall 38 and these define a groove between them. The strip 32 of the spike band 30 is received within the groove and secured to the inner wall 36 and/or the outer wall 38. Such securement may be achieved frictionally or adhesively. Alternatively, heat may be used to mechanically bond the strip 32 to the inner wall 36 and/or the outer wall 38. The spikes 34 extend downwardly beyond the inner wall 36 and the outer wall 38 so that they are forced into the ground below the guard 10 to hold it fast relative to the ground on which the guard 10 sits. The spike band 30 may be a single piece with two ends that are adjacent when the spike band 30 is fully positioned within the groove in the raised rim 14, as shown in FIG. 2. Alternatively, two or more spike strips (not shown) may be used in place of single spike strip 30. Multiple spike bands may have a total combined length that is the same as the length of the groove or a total combined length that is less than the length of the groove. The ratio of the total combined length of spike bands to the length of the groove is preferably between 1:1 and 1:4 and, more preferably, between 1:1 and 1:3 and, even more preferably, between 1:1 and 1:2.

As shown in FIG. 2, a portion 40 of the spike band 30 spans the slit 28. To the left of the slit, at least a portion of the strip 32 of the spike band 30 is secured to the inner wall 36 and/or the outer wall 38. To the right of the slit 28, the strip 32 of the spike band 30 is not secured to the inner wall 36 or the outer wall 38 so that it is free to move into and out of the groove. After the guard 10 has been positioned around a post, the portion of the strip 32 of the spike band 30 that is not secured to the inner wall 36 or the outer wall 38 is positioned back into the groove between the inner and outer walls 36 and 38. This stabilizes the structure and helps to maintain it in the desired configuration.

A slit cover 42 spans the slit indicated at 28. The cover 42 is adhered to or otherwise fastened to the planar sheet 12 on one side of the slit 28 but is not fastened to the planar sheet 12 on the other side of the slit 28. When the guard 10 is in the unflexed state, the slit cover 42 covers the slit 28 and serves to ensure that vegetation will not grow through the slit 28. When the guard 10 is flexed, the portion of the slit cover 42 that is not fastened to the planar sheet 12 will lift off of the planar sheet 12 to facilitate the task of positioning the guard 10 around a post. The slit cover 42 is illustrated as being positioned on an upper surface of the planar sheet 12. The slit cover 42 may, instead, be positioned on the underside of the planar sheet 12 to the same effect.

Figure 7:
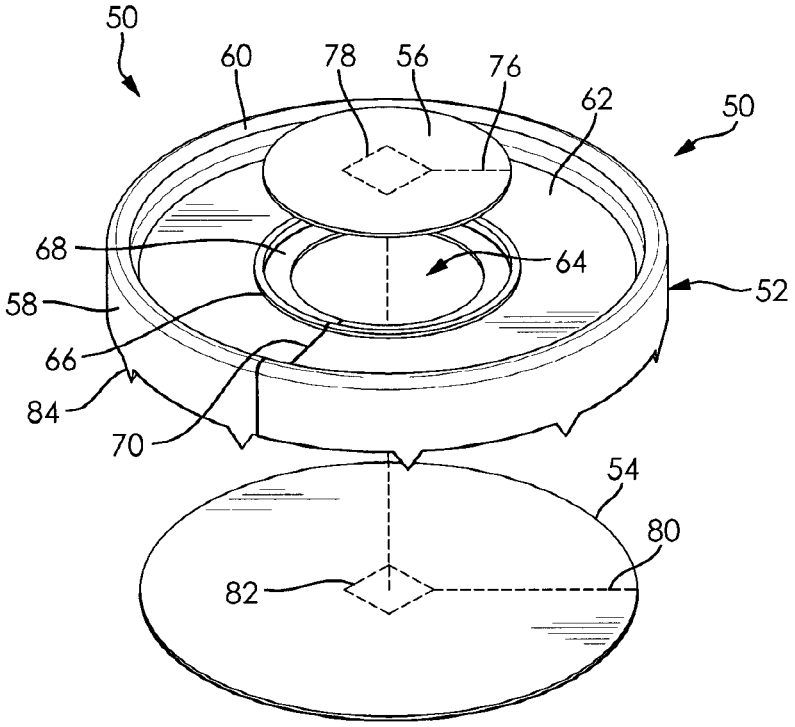
FIG. 7 is an exploded perspective view showing the components of a second embodiment of a landscaping guard according to the invention.

Referring now to FIGS. 7 through 10, a second example of a landscape guard is indicated generally at 50 in FIG. 7. The guard 50 comprises a base 52, a lower collar 54, and an upper collar 56. The base comprises a side wall 58 extending upwardly to a lip 60. Below the upper lip 60, there is a tray 62 which extends inwardly to a large central opening indicated at 64. A raised lip 66 surrounds the opening 64 and a flange 68 extends inwardly a short distance from the raised lip 66. A radial slit indicated at 70 extends from the side wall 58 of the base 52 to the large central opening 64.

The lower collar 54 has a periphery such that it fits inside of the side wall 58. It is preferred that the periphery of the lower collar 54 be such that it is almost coextensive with the interior of the side wall 58. The lower collar 54 may be provided with guide lines including a radial guide line 72 and central opening guide lines 74. A plurality of central opening guide lines of different sizes and configurations may be provided so that the lower collar 54 may be adapted to different sizes and cross sections of posts, as desired.

The upper collar 56 has a periphery such that it fits inside of the raised lip 68 that surrounds the opening 66. It is preferred that the periphery of the upper collar 56 be such that it is almost coextensive with the inside of the raised lip 66. It is also preferred that a portion of the upper collar 56 overlay the flange 68 when the upper collar 56 is positioned inside of the raised lip 66. The upper collar 56 may be provided with guide lines including a radial guide line 76 and central opening guide lines 78. A plurality of central opening guide lines of different sizes and configurations may be provided so that the upper collar 56 may be adapted to different sizes and cross sections of posts, as desired. It is preferred that the lower and upper collars 54 and 56 be made from a durable material having a thickness such that it can be cut with common scissors or shears.

Figure 8:
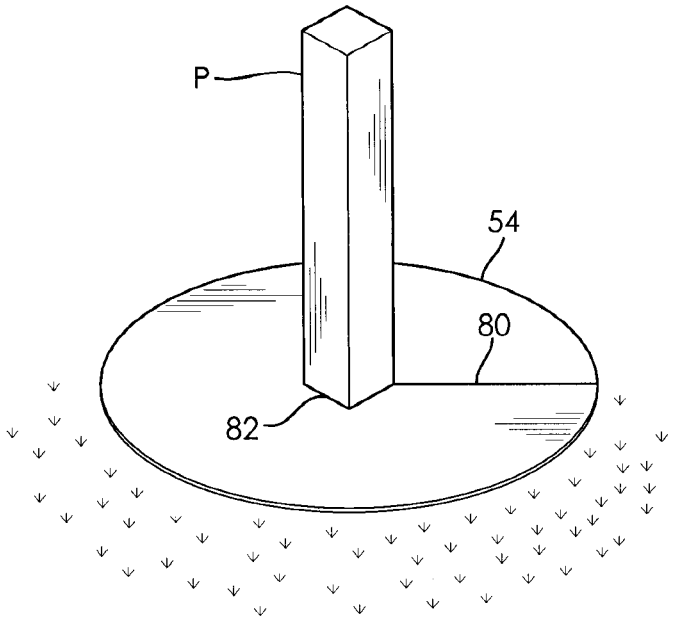
FIG. 8 is a perspective view of a lower collar of the second embodiment of a landscaping guard, positioned on the ground around a post.
Figure 9:
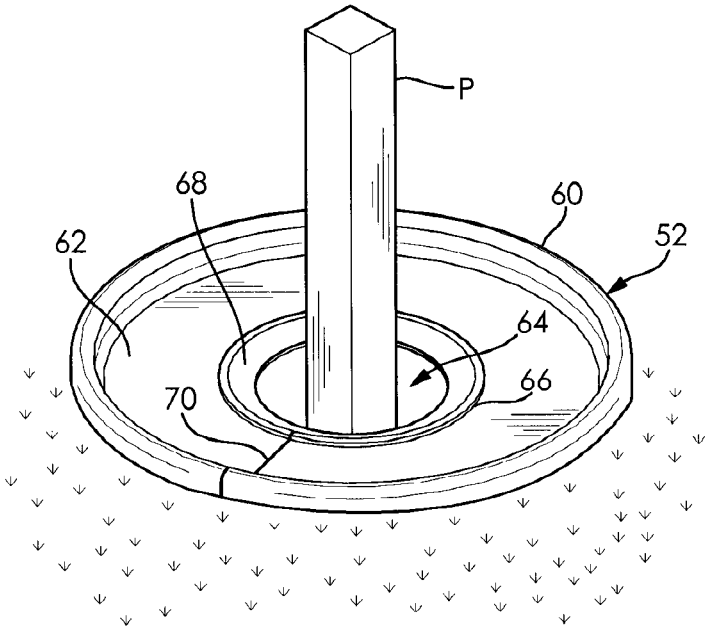
FIG. 9 is a perspective view a base of the second embodiment of a landscaping guard, positioned in the ground around a post.

In FIG. 8, the lower collar 54 has been cut to provide a radial slit 80 and a central post opening 82. The lower collar 54 has been positioned on the ground around a post P using the slit 80. The outer edge of the lower collar 54 may serve as a template for defining the shape and size of a hole to be cut into the ground for receiving the base 52. The periphery of the hole will be slightly larger than the periphery of the lower collar 54. If the lower collar 54 is used as a template, the ground can be marked and the collar 54 removed while the hole is dug. The hole may be as deep as the height of the side wall 58, or a little less in which case the lip 60 will extend above ground level. After a hole has been dug, the lower collar 54 is repositioned around the post P on the bottom of the hole. With the lower collar 54 in place, the base 52 is positioned around the post P, using the slit 70, as shown in FIG. 9. Ground engaging spikes 84 (FIG. 7) may be provided on the base 52 extending downwardly from the side wall 58. The spikes 84 will engage the ground to provide a secure footing for the base 52 when it is positioned in a hole in the ground.

Figure 10:
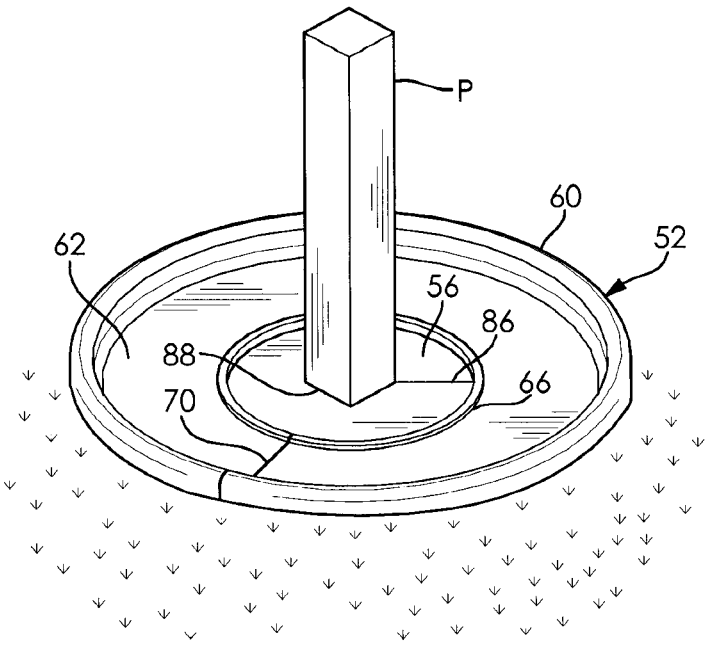
FIG. 10 is a perspective view the base of the second embodiment of a landscaping guard, positioned in the ground, around a post, with an upper collar in place.

At this point, it is time to complete the installation by installing the upper collar 56. A radially extending slit 86 has been cut in the upper collar 56 and a central post opening 88 has also been cut. It is preferred that the central post opening 88 be sized so that the upper collar 56 snugs up tightly against the post P. The base 52, the lower collar 54 and the upper collar 56 have radial slits 70, 80, and 86. It will be apparent from FIGS. 7 through 10 that, when the guard 50 is installed as shown in FIG. 10, the slits 70, 80, and 86 do not overlap. Thusly, at every location on the guard 50, there will be at least two uninterrupted layers of the landscape guard 50 to inhibit/prevent undesired growth of vegetation.

It will be obvious to one of ordinary skill in the art that many modifications and variations can be made to the preferred embodiments described above without departing from the novel teachings of the present invention. Such modifications and variations are incorporated herein to the extent that they are within the spirit and scope of the following claims.

I claim:

1. A landscaping post guard comprising a unitary base, a lower collar, and an upper collar, wherein said unitary base comprises a side wall having an upper lip, a tray extending inwardly from said side wall below said lip, a central opening in said tray, a raised lip around said central opening, and a flange extending inwardly from said raised lip around said central opening, wherein said lower collar fits inside of said side wall and an outer edge of said lower collar is adjacent to said side wall when said lower collar is inside of said side wall, below said tray, and wherein said upper collar is larger than said central opening and said upper collar fits inside of said raised lip around said central opening.

2. The landscaping post guard claimed in claim 1 wherein a radial slot extends in said base from said central opening to and through said side wall.

3. The landscaping post guard claimed in claim 1 wherein said lower collar has a radial guide line and opening guide lines.

4. The landscaping post guard claimed in claim 1 wherein said upper collar has a radial guide line and opening guide lines.

5. The landscaping post guard claimed in claim 1 wherein said side wall has downwardly extending ground engaging spikes.

6. The landscaping post guard claimed in claim 1 wherein said upper collar overlays said flange when said upper collar is positioned within said raised lip around said central opening.

7. A landscaping post guard comprising a sheet of flexible material having a raised rim that extends upwardly from and around a periphery of the planar sheet and a central wall extending upwardly from the sheet, wherein tabs extend inwardly from an upper portion of said central wall and engage a post when it is positioned within said central wall, wherein a slit extends from the raised rim to the central wall so that the guard may be manipulated and positioned around a post with said central wall surrounding the post.

8. The landscaping post guard claimed in claim 7 wherein said raised rim is defined by an inner wall and an outer wall which define a rim groove that opens downwardly, and said landscaping post guard further comprises a spike band that is received in and secured in said rim groove so that spikes on said spike strip extend downwardly.

9. The landscaping post guard claimed in claim 7 and further comprising a slit cover operable to span said slit.

10. The landscaping post guard claimed in claim 8 and further comprising a slit cover operable to span said slit.

11. The landscaping post guard claimed in claim 7 and further comprising fasteners operable to connect said central upwardly extending wall and said tabs to a post positioned in said central upwardly extending wall.

12. A landscaping post guard comprising a base, a lower collar, and an upper collar, wherein said base comprises a side wall having an upper lip, a tray extending inwardly from said side wall, below said lip, a central opening in said tray, and a slit extending from said central opening through said tray and said side wall, wherein said lower collar is smaller than said tray so that said lower collar fits inside of said side wall and, when said lower collar is inside of said side wall, said lower collar covers at least a portion of said central opening, and wherein said upper collar is larger than said central opening in said base.

13. The landscaping post guard claimed in claim 12 and further comprising a raised lip around said central opening.

14. The landscaping post guard claimed in claim 13 wherein said tray includes a flange extending inwardly from said raised lip around said central opening.

15. The landscaping post guard claimed in claim 13 wherein said upper collar fits within said raised upper lip around said central opening.

16. The landscaping post guard claimed in claim 12 wherein said lower collar has a radial guide line and opening guide lines.

17. The landscaping post guard claimed in claim 13 wherein said upper collar has a radial guide line and opening guide lines.

18. The landscaping post guard claimed in claim 12 wherein said side wall has downwardly extending ground engaging spikes.

19. The landscaping post guard claimed in claim 14 wherein said upper collar overlays said flange when said upper collar is positioned within said raised lip around said central opening.

* * * * *